US005263520A

United States Patent [19]

Arai

[11] Patent Number: 5,263,520

[45] Date of Patent: Nov. 23, 1993

[54] AIR-SUCTION NOZZLE FOR COMPACTION OF TRASH BAG

[75] Inventor: Kazuo Arai, Tokyo, Japan

[73] Assignee: Free Hand, Inc., Tokyo, Japan

[21] Appl. No.: 928,434

[22] Filed: Aug. 12, 1992

[51] Int. Cl.[5] ..... B65B 31/04

[52] U.S. Cl. ..... 141/65; 141/114; 141/314; 141/7; 53/512

[58] Field of Search ..... 141/65, 86, 114, 314, 141/10, 7, 8; 53/512

[56] References Cited

U.S. PATENT DOCUMENTS

| | | | |
|---|---|---|---|
| 2,695,741 | 11/1954 | Haley | 141/65 |
| 3,312,256 | 4/1967 | Reisinger | 141/65 |
| 3,511,020 | 5/1970 | Kraft et al. | 53/512 |
| 3,527,018 | 9/1970 | Jahnke | 53/512 |
| 3,580,300 | 5/1971 | Dunn, Jr. | 141/65 |
| 3,628,576 | 12/1971 | Owen | 141/65 |
| 3,648,740 | 3/1972 | Pruitt | 141/8 |
| 3,722,558 | 3/1973 | Worline | 141/65 |

*Primary Examiner*—Ernest G. Cusick

[57] ABSTRACT

An air-suction nozzle for greatly improving the efficiency of waste disposal by compacting trash-filled bags. The air-suction nozzle has a hub member having an opening to communicate with an air-suction line, an outer tube air-tightly held by the hub member and having perforations, an inner tube held by the hub member concentrically with the outer tube and having at least one perforation at a position close to the hub member and communicating with the opening in the hub member, and a plug member sealing and holding the outer and inner tubes concentric at the respective ends remote from the hub member. The air inside a trash-filled plastic bag can be sucked out through the nozzle inserted into the bag without sucking of water even when the trash is wet.

3 Claims, 3 Drawing Sheets

AIR-SUCTION NOZZLE FOR COMPACTION OF TRASH BAG

BACKGROUND OF THE INVENTION

The present invention relates to an air-suction nozzle for compaction of a trash bag or, more particularly, to an air-suction nozzle by which the air inside of a trash bag made of an air-impermeable material, e.g., plastic films, and filled with trash can be efficiently sucked or drawn out so as to greatly reduce the volume of the trash-filled bag to facilitate handling and disposal thereof.

Needless to say, one of the most important environmental issues not only in developed countries but also in developing countries is disposal of waste including paper scraps, used wrapping materials of plastics and the like. These materials are usually disposed of in such a way that they are packed in a large bag usually made of an air-impermeable material such as plastic films and the trash-filled plastic bags deposited on the spots here and there within the city are collected and carried away by the scavengery service of the city to be disposed of by incineration or deposit in a landfill. A problem in this system of waste disposal is that the trash-filled plastic bags are sometimes or mostly very bulky in relation to the weight of the trash contained therein so as to cause disadvantages that not only big heaps of the trash-filled bags are formed on the depository sites in the city but also the efficiency of the city service for scavengery is greatly decreased by limiting the effective load capacity of the disposal trucks and decreasing the effective capacity of incineration furnaces. Accordingly, it is eagerly desired to reduce the volume of a trash-filled plastic bag by excluding the air inside of the bag so as to improve the efficiency of the waste-disposal service.

A most simple way to exclude the air in a trash-filled plastic bag is to insert a pipe, which serves as an air-suction nozzle, into the bag and to connect the air-suction nozzle to a suitable suction means such as a vacuum pump or, conveniently, a household vacuum cleaner so that the air inside of the bag can be sucked out resulting in compaction of the trash-filled plastic bag. This way of air suction, however, is hardly applicable in practice to trash-filled plastic bags because the trash in the trash bags unavoidably includes kitchen garbage and is sometimes wet with dirty water so that suction through a simple nozzle necessarily causes intrusion of water into the vacuum pump or vacuum cleaner so as to damage them.

SUMMARY OF THE INVENTION

The present invention accordingly has as an object to provide an air-suction nozzle for compaction of a trash-filled bag without the above mentioned troubles due to intrusion of water into the suction line connected to a vacuum pump or vacuum cleaner.

Thus, the air-suction nozzle of the invention for compaction of a trash-filled bag comprises:

(a) a hub member having an opening leading to an air-suction (b) an outer tube air-tightly held at one end by the hub member;

(c) an inner tube held at one end by the hub member concentrically with the outer tube and communicating with the opening in the hub member to form a space between the inner surface of the outer tube and the outer surface of the inner tube; and (d) a plug member sealing and holding the outer tube and the inner tube concentrically at the respective ends remote from the hub member, the outer tube having a plurality of perforations distributed along the axial length and the inner tube having at least one perforation at a position close to the hub member.

It be preferable that the plug member is provided with at least one groove extending in the axial direction of the nozzle and communicating with the space between the outer and inner tubes to serve as a drainage channel.

DETAILED DESCRIPTION OF THE PREFERRED EMBODIMENTS

As is described above, the air-suction nozzle of the invention comprises four members as the essential components including (a) a hub member, (b) an outer tube, (c) an inner tube and (d) a plug member. In the following, the air-suction nozzle of the invention is described in detail with reference to the accompanying drawings.

Figure 1:
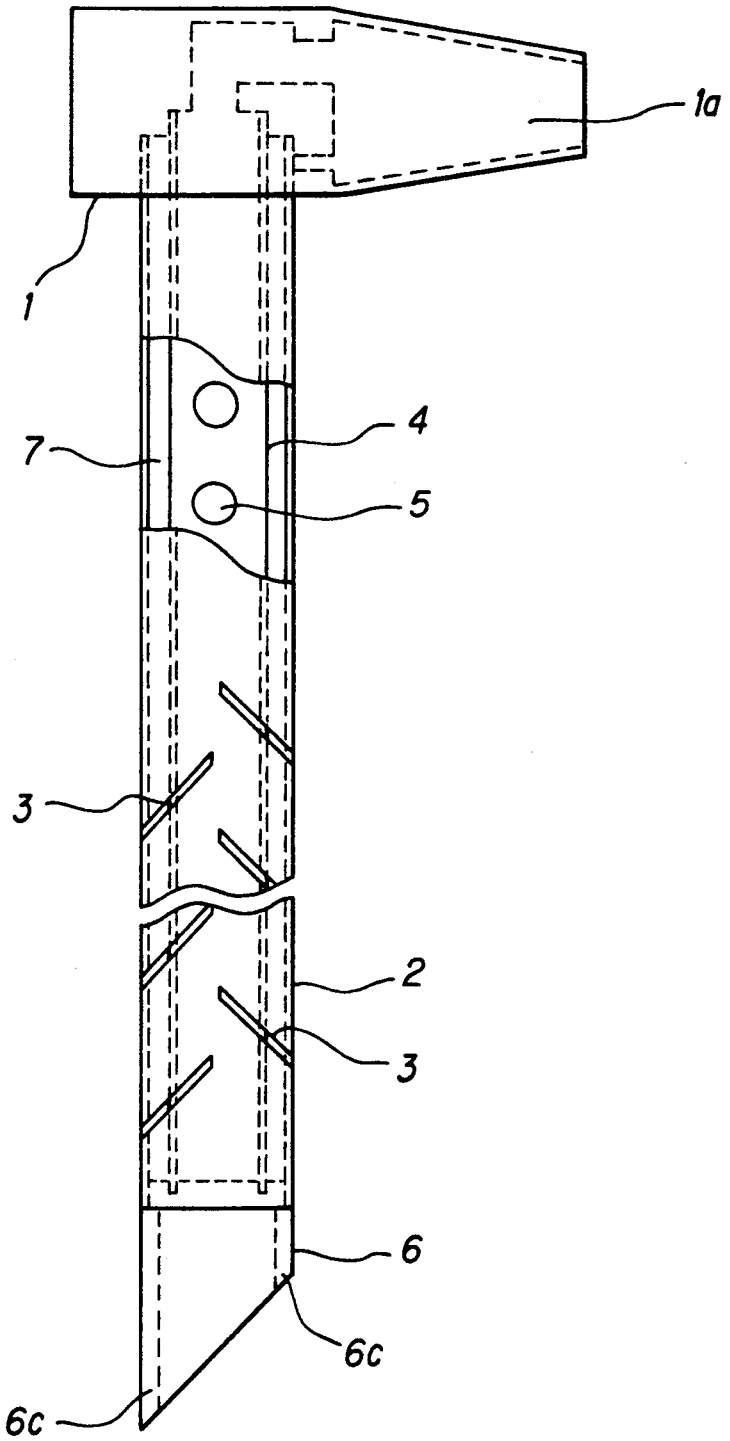
FIG. 1 is a side view of the inventive air-suction nozzle with the outer tube partly cut away to show the inner tube having perforations.

In FIG. 1, the hub member 1, which is made from a metallic material, has an opening 1*a* at which the hub member 1 can be connected to an air-suction hose (not shown in the figure) and the like coming from a vacuum pump or a vacuum cleaner. It is advantageous that the hub member 1 is tapered toward the opening 1*a*, as is shown in FIG. 1, so as to facilitate connection with a suction hose (not shown in the figure).

The hub member 1 holds an outer tube 2 air-tightly at one end thereof. The outer tube 2 is made preferably from stainless steel in consideration of the corrosion resistance and easiness in cleaning with water to wash away any dirt having an unpleasant odor coming from the trash. The outer tube 2 has an outer diameter of 15 to 25 mm, although not particularly limited thereto, and the wall thickness thereof can be small provided that the tube has a sufficient mechanical strength for handling. The length of the outer tube 2 can be in the range from 40 to 60 cm. When the length of the outer tube 2 is too small, the air-suction nozzle cannot be inserted into a trash-filled plastic bag with good reliability while any larger length than above gives no particular additional advantages but rather causes some inconvenience in handling.

As is shown in FIG. 1, the outer tube 2 has a plurality of perforations 3 distributed along the axial length of the tube 2. In FIG. 1, each of the perforations 3 has a slit-like form extending in a direction inclined relative to the axial direction and the slits are distributed in several rows around the tube, the running direction of the slit-formed perforations 3 in a row crossing the running direction of the slit-formed perforations 3 in the adjacent rows. It is of course optional that the perforations can each be a simple circular opening and can be distributed at suitable intervals. The perforations, when they are in the form of a circular opening, each have a diameter of 1 to 2 mm and, when they are in the form of an elongated slit, each have a width of 1 to 2 mm and a length of 10 to 15 mm, although not particularly limited thereto. When the size of the perforation is too large, troubles are caused by sucking tiny fragments of trash into the space between the outer and inner tubes while, when the size is too small, the perforations may readily be clogged with dust particles. The perforations 3 can be distributed over substantially whole length of the outer tube 2 excepting a 10 to 20 cm long portion from the end at which the outer tube 2 is air-tightly held by the hub member 1.

Concentrically with the outer tube 2, an inner tube 4, which also is made preferably from stainless steel, is held at one end by the hub member 1. This inner tube 4 is communicated with the opening 1*a* in the hub member 1. The diameter of the inner tube 4 is not particularly limited but the space formed between the inner surface of the outer tube 2 and the outer surface of the inner tube 4 should be as large as possible although an inner tube 4 having a too small diameter is undesirable in respect of the low mechanical strength and possible troubles due to clogging. The length of the inner tube 4 is of course about the same as the outer tube 2 since the outer tube 2 and the inner tube 4 are concentrically held by common holding members of, at one end, the hub member 1 and at, the other end, a plug member described below.

As is shown in FIG. 1 at the portion where the outer tube 2 is partly cut away, the inner tube 4 has at least one perforation 5 a the position close to the hub member 1 to serve as the passage way for air. Although a single perforation 5 may be fully serviceable as a passage way for air, it is preferable to provide a plural number of perforations 5 as is shown in FIG. 1 to guard against an accidental clogging of the perforation 5. It is preferable in such a case that the area in which perforations 5 are formed on the inner tube 4 does not extend so far as to have the perforations 5 directly facing the perforations 3 on the outer tube 2 in order to avoid direct intrusion of water from wet trash through the perforations 3 in the outer tube 2 and the perforations 5 in the inner tube 2.

Figure 2A:
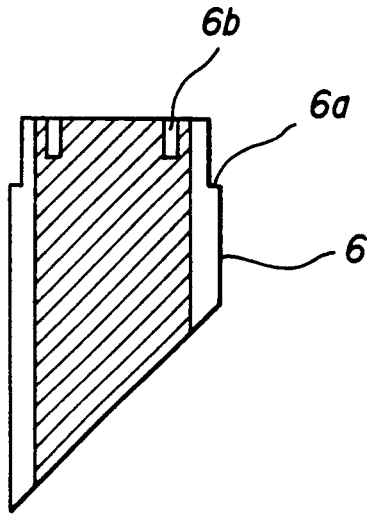
FIGS. 2*a* and 2*b* are an axial cross sectional view and an end view of the plug member, respectively.
Figure 2B:
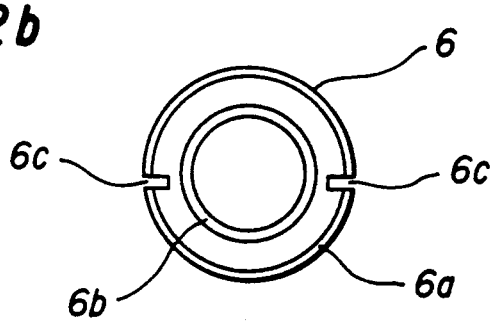

The above described outer tube 2 and the inner tube 4 are held concentrically by the hub member 1 at one end and by a plug member 6 at the other end so as to be sealed therewith. The diameter of the plug member 6 is about the same as the outer diameter of the outer tube 2. The material of this plug member 6 is not particularly limited but it can be formed from a polymeric material such as plastic resins, hard rubbers and the like. As is shown by the axial cross sectional view thereof in FIG. 2*a*, the plug member 6 has a step 6*a* and circular groove 6*b* to facilitate connection with the outer tube 2 and inner tube 4, respectively. Namely, the lower ends of outer tube 2 and inner tube 4 remote from the hub member 1 are inserted into the step 6*a* and circular groove 6*b* of the plug member 6 and fixed to the plug member 6, if necessary, by using an adhesive. Though not essential, the other end of the plug member 6 not holding the outer and inner tubes is cut aslant in order to facilitate insertion of the nozzle into a trash-filled bag.

It is advantageous that the plug member 6 is provided with at least one groove 6*c* extending in the axial direction from one end to the other. Since this groove 6*c* is to serve as a drainage channel, it is important that the groove 6*c* be communicated with the space 7 formed between the outer tube 2 and the inner tube 4 when the tubes are assembled with and held together by the plug member 6. When the air-suction nozzle of the invention is inserted into a plastic bag filled with wet trash and the opening 1*a* of the hub member 1 is connected to an air-suction line, water may eventually be sucked into the space 7 through the perforations 3 in the outer tube 2 and the water, which otherwise would be pooled in the space 7 below the perforations in the outer tube 2, can be drained through the groove 6*c* in the plug member 6 either while under continued suction or by shutting off the air-suction line.

Figure 3:
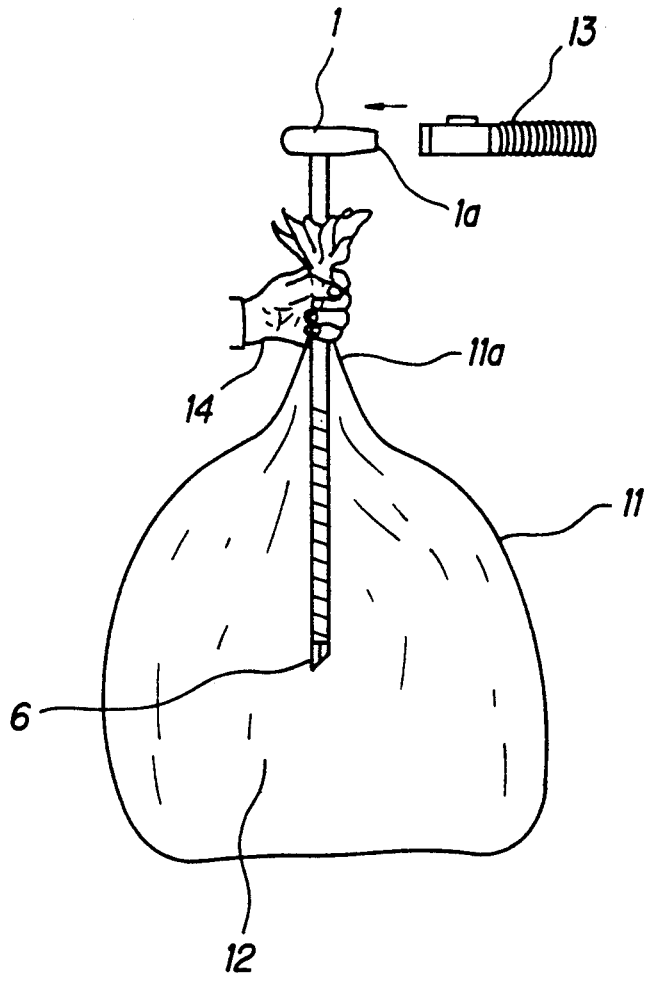
FIG. 3 illustrates the inventive air-suction nozzle in use as inserted into a trash-filled bag.

FIG. 3 schematically illustrates the inventive air-suction nozzle in practical use. In the first place, the nozzle is inserted at the end capped with the plug member 6 into a plastic trash bag 11 filled with trash 12. The opening 1*a* of the hub member 1 is connected to an air-suction hose 13 coming from a vacuum pump or vacuum cleaner (not shown in the figure). When the mouth portion 11*a* of the trash bag is squeezed by a hand in an air-tight fashion, the air inside the trash bag is drawn and discharged through the passage way formed by the perforations 3 in the outer tube 2, perforations 5 in the inner tube 4 and the opening 1*a* of the hub member 1 so that the trash-filled bag 11 is compacted by being pressed under atmospheric pressure. When the air inside the trash bag 11 has been fully sucked out in this manner resulting in compaction of the bag, the air-suction nozzle is quickly pulled out of the trash bag and the mouth portion 11*a* of the trash bag while being squeezed with a hand is tightly tied up with a string or rubber band or fastened with a clamp so as to resist expansion of the once compacted trash and prevent the bag from swelling.

When the trash 12 contained in the trash bag 11 is wet with water, the water is also sucked through the perforations 3 in the outer tube 2 to form a pool in the space 7 between the tubes. The pooled water, however, can be easily discharged through the perforations 3 in the lower portion of the outer tube 2 although a little volume of water unavoidably remains in the space 7. This remaining volume of water at the bottom portion of the space 7 can be easily discharged through the grooves 6*c* in the plug member 6 when the nozzle is pulled out of the trash bag 11 and the suction hose 13 is released from the opening 1*a* of the hub member 1. The nozzle after use can be kept in a sanitary condition by connecting the opening 1*a* with a water hose and back-washing with water.

What is claimed is:

1. An air-suction nozzle for compaction of a trash-filled bag which comprises:

(a) a hub member having an opening for connection to an air-suction means;

(b) an outer tube air-tightly held at one end thereof by the hub member;

(c) an inner tube held at one end thereof by the hub member concentrically with the outer tub and communicating with the opening in the hub member, said outer and inner tubes defining a space between the inner surface of the outer tube and the outer surface of the inner tube; and (d) a plug member concentrically holding the outer tube and the inner tube in sealing engagement at the respective ends remote from the hub member, the outer tube having a plurality of perforations distributed along the axial length thereof and the inner tube having at least one further perforation at a position close to the hub member.

2. The air-suction nozzle as claimed in claim 1 in which the plug member is provided with at least one groove extending in the axial length direction of the nozzle and communicating with the space between the outer and inner tubes to serve as a drainage channel.

3. The air-suction nozzle as claimed in claim 1 in which the area of the inner tube in which said at least one further perforation is provided does not extend so far from said hub member as to have the at least one further perforation in the inner tube directly facing any of the perforations in the outer tube.

* * * * *